US005944271A

United States Patent [19]

Savujärvi et al.

[11] Patent Number: 5,944,271

[45] Date of Patent: Aug. 31, 1999

[54] HIGH CONSISTENCY DAMLESS REFINER PLATE FOR WOOD FIBERS

[75] Inventors: Petri Savujärvi, Brookfield, Wis.; Mattias Löfgren, Yxlan, Sweden

[73] Assignee: J&L Fiber Services, Inc., Waukesha, Wis.

[21] Appl. No.: 08/919,710

[22] Filed: Aug. 28, 1997

[51] Int. Cl.[6] ..... B02C 7/12

[52] U.S. Cl. ..... 241/261.3; 241/298

[58] Field of Search ..... 241/296, 297, 241/298, 261.2, 261.3

[56] References Cited

U.S. PATENT DOCUMENTS

| | | | |
|---|---|---|---|
| 1,244,514 | 10/1917 | Letz | 241/296 |
| 1,306,468 | 6/1919 | Covert et al. | 241/296 |
| 1,587,863 | 6/1926 | Rynders | 241/296 |
| 1,609,717 | 12/1926 | Holland-Letz . | |
| 1,609,718 | 12/1926 | Holland-Letz . | |
| 1,612,437 | 12/1926 | Holland-Letz | 241/296 |
| 4,676,440 | 6/1987 | Perkola . | |
| 4,772,358 | 9/1988 | Virving . | |
| 4,953,796 | 9/1990 | Virving . | |
| 5,165,592 | 11/1992 | Wasikowski . | |
| 5,181,664 | 1/1993 | Kohler . | |
| 5,373,995 | 12/1994 | Johannson . | |
| 5,383,617 | 1/1995 | Deuchars . | |
| 5,425,508 | 6/1995 | Chaney . | |

*Primary Examiner*—Mark Rosenbaum
*Attorney, Agent, or Firm*—Nilles & Nilles S.C.

[57] ABSTRACT

The refiner plate of this invention has a pattern of interlocking or nested elements having a "I"s "T"s, "S"s, "L"s, "F"s, "E"s, or "H"s shape which form channels. The body of the elements forms the refiner bars which hold the fibers as they move between the refiner plates in a disk refiner. The pattern of elements retarded the flow of fibers while at the same time providing a large open area for steam to pass through the refiner disks. The segments making up the elements producing a refiner bar which is reinforced for higher strength. The shape of the elements has a increased edge length exposed to the flow of fibers.

63 Claims, 4 Drawing Sheets

HIGH CONSISTENCY DAMLESS REFINER PLATE FOR WOOD FIBERS

FIELD OF THE INVENTION

This invention relates to refiners which treat paper pulp fibers in general and to high consistency disk refiners in particular.

BACKGROUND OF THE INVENTION

During the production of fibers for papermaking, wood or another source of fibers is processed into chips and mechanically or chemically treated such that the chips may be broken down further and refined into individual fibers.

High consistency disk refiners are used with stock containing eighteen to sixty percent fiber by weight. High consistency refiners produce mechanical and semichemical pulp or furnish from undigested wood chips and semidigested wood chips. The refiner breaks down wood chips and clumps of wood fibers into individual fibers from which paper may be formed. After processing in a high consistency refiner, the fibers may be further processed in, for example, a low consistency refiner to improve their freeness or bonding capability.

A refiner disk consists of a disk-shaped steel or steel-alloy casting which has a multiplicity of generally radially extending bars integrally cast to extend from the surface of the disk. A first refiner disk is mounted on a rotor for rotation and another disk is held opposed to the first refiner disk, either by rigid mounting or by mounting on an oppositely rotating rotor. The refiner disks, as they move past each other, separate and refine the wood pulp as it passes between the opposed disks.

When dealing with high consistency pulp and wood chips, the edges of the refiner bars act as cutting edges for separating fibers from wood chips or clumps of fibers.

Disc refiners are used in the papermaking industry to prepare the cellulose fibers prior to delivering the pulp to the papermaking machine.

It is the purpose of a stock refiner to modify and separate the fibers without significantly reducing the length or individual strength of these fibers. The action of the refiner requires that the fibers pass through the refiner disks slowly. The energy which is expended to drive the refiner results in the generation of steam between the refiner disks. Fibers are typically retained on the refiner disks by placing dams between the substantially radially extending bars on the disks. Dams between refiner bars prevent the fibers and stock from being rapidly pumped through the refining region created by the refiner disks.

The use of dams, however, blocks the flow of steam from the refiner disks. When steam is blocked, it can back up and prevent fibers from moving through the refiner disks. If the dams are removed, the steam can blow the stock out of the disks before sufficient refining action has taken place. Refiners are energy intensive pieces of equipment and building a better refiner means a higher throughput with the same or better refining action.

Refiner disks have been fabricated with curved steam exhaust channels which extend radially outwardly and cut across refining grooves and bars. These large-width channels provide a low-resistance path for the escape of steam generated in the refining process, but come only at the sacrifice of a significant portion of refiner bar length, and hence a reduction from the maximum potential refining capacity.

What is needed is a disc refiner which provides improved steam flow with better retention of fibers and increased refining action on the refiner disks.

SUMMARY OF THE INVENTION

The refiner plate of this invention has a pattern of projections in the shape of a series of interlocking serif roman capital letter I's which form channels. The bodies of the I's form the refiner bars which hold the fibers as they move between the refiner plates in a disk refiner. The pattern of I's retards the flow of fibers while at the same time providing a large open area for steam to pass through the refiner disks. The cross bars at the top and at the bottom of the I's support the body of the I producing a refiner bar which is reinforced for higher strength. The shape of the I has an increased edge length exposed to the flow of fibers. The result is a pattern of bars on a refiner disk which has a large open area for steam and at the same time improved retention and processing of wood fibers.

It is a feature of the present invention to provide a high consistency refiner disk with greater area for steam to escape.

It is a further feature of the present invention to provide a high consistency refiner disk with a bar element which provides greater refining capability.

It is a still further feature of the present invention to provide a high consistency refiner disk which employs refining bar elements of greater strength.

Further objects, features and advantages of the invention will be apparent from the following detailed description when taken in conjunction with the accompanying drawings.

DESCRIPTION OF THE PREFERRED EMBODIMENTS

Figure 1:
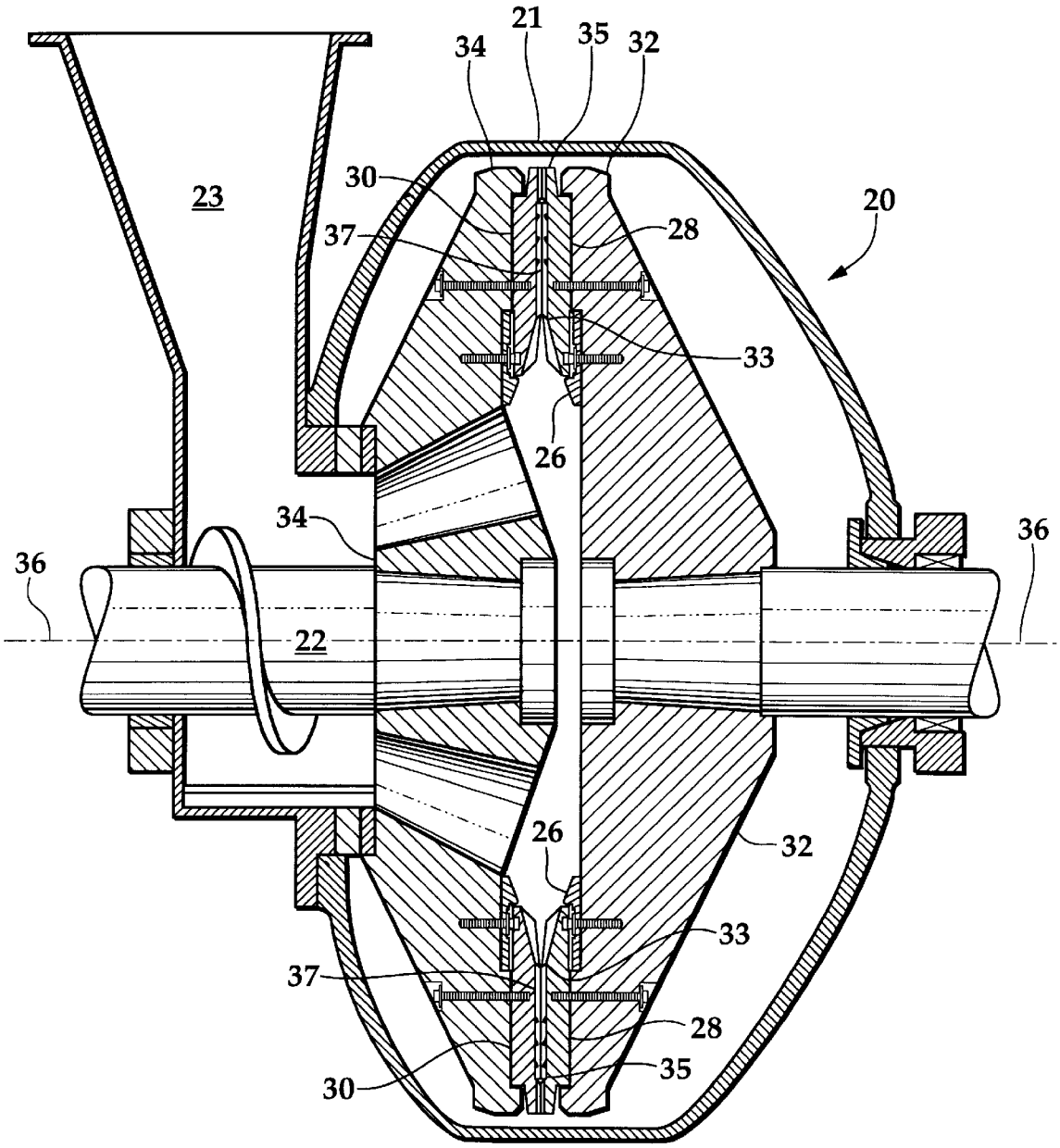
FIG. 1 is a cross-sectional view of a high consistency stock disk refiner which may be used with the refiner disks of this invention.
Figure 2:
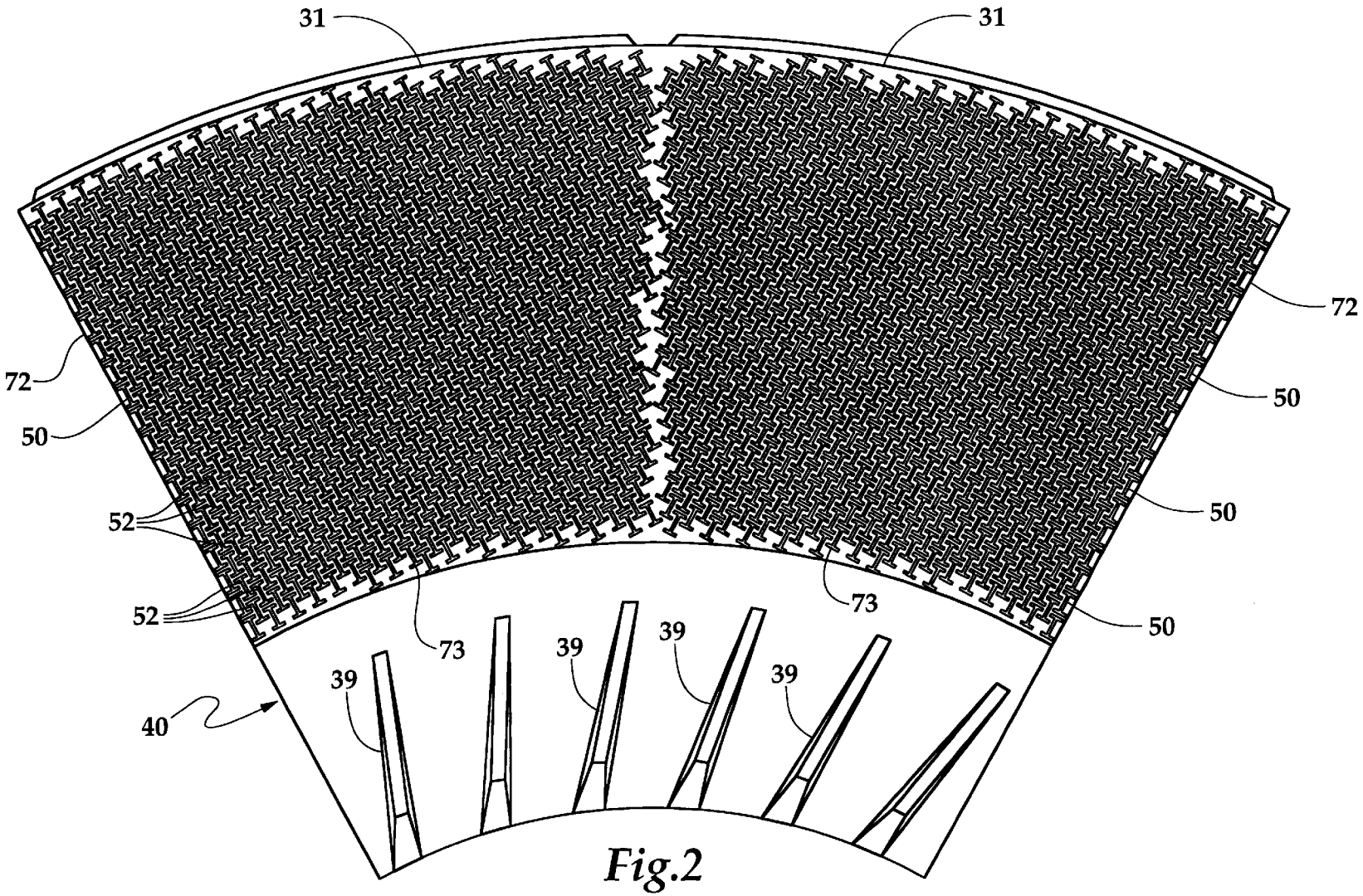
FIG. 2 is a top plan view of a sector of the refiner disk of this invention showing the pattern of refiner bars.

Referring more particularly to FIGS. 1–8, wherein like numbers refer to similar parts, a typical high-consistency pulp refiner 20 is shown in FIG. 1. The refiner 20 has a housing 21 with a stock inlet 23 through which stock is introduced. The refiner 20 has an auger 22 which supplies a high consistency pulp or wood chip feed consisting of eighteen to sixty percent wood chips and wood fiber suspended in water. The auger 22 supplies fibers and/or wood chips to a breaker bar section 26 and hence to a refiner section comprised of a first refiner disk 28 and a second refiner disk 30. The refiner disks 28, 30 are generally annular members, typically composed of a number of cast sectors 31 as shown in FIG. 2. The refiner disks have inner edges 33 near the axis 36 and outer edges 35 spaced radially outwardly from the axis. The refiner disks define an annular refining region 37 between the inner edges 33 and the outer edges 35 through which wood chips and fibers flow under centrifugal force. The refiner disks 28, 30 have refiner bars or elements 50 in the shape of capital serif letter I's. The refiner elements 50 are integrally formed on the faces or refining surfaces of the opposed disks 28, 30 and thus face each other.

One refiner disk 28 is mounted to a rotor 32 parallel to a radially extending plane, the other refiner disk 30 is mounted to a counter-rotating rotor 34. The rotors 32, 34 and the attached refiner disks 28, 30 rotate about an axis 36.

Figure 3:
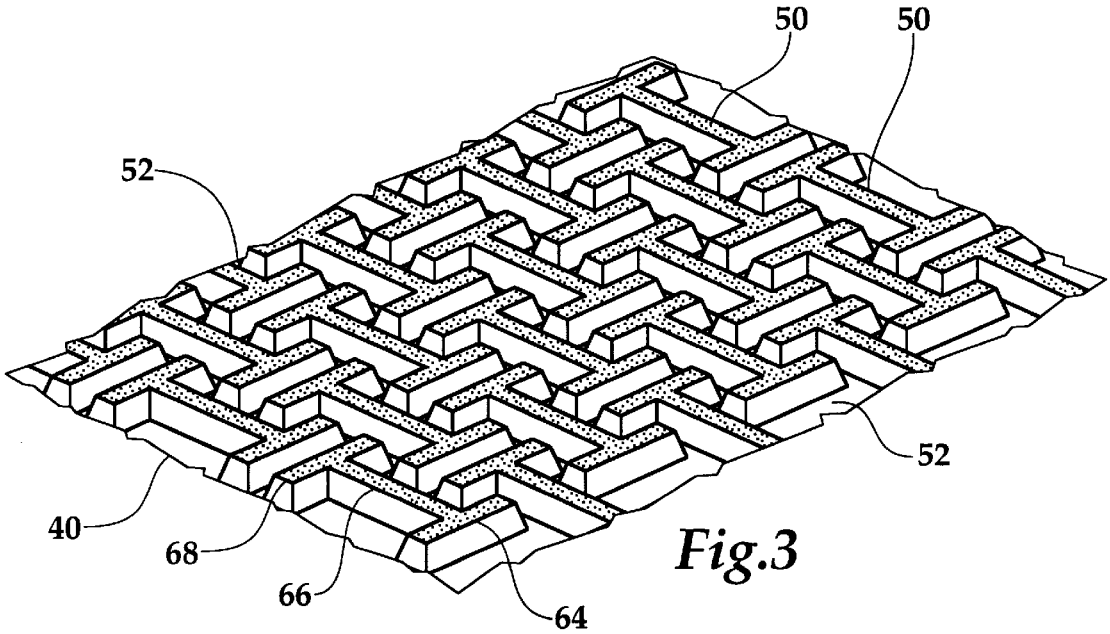
FIG. 3 is an enlarged fragmentary isometric view of the refiner disk of FIG. 2.
Figure 4:
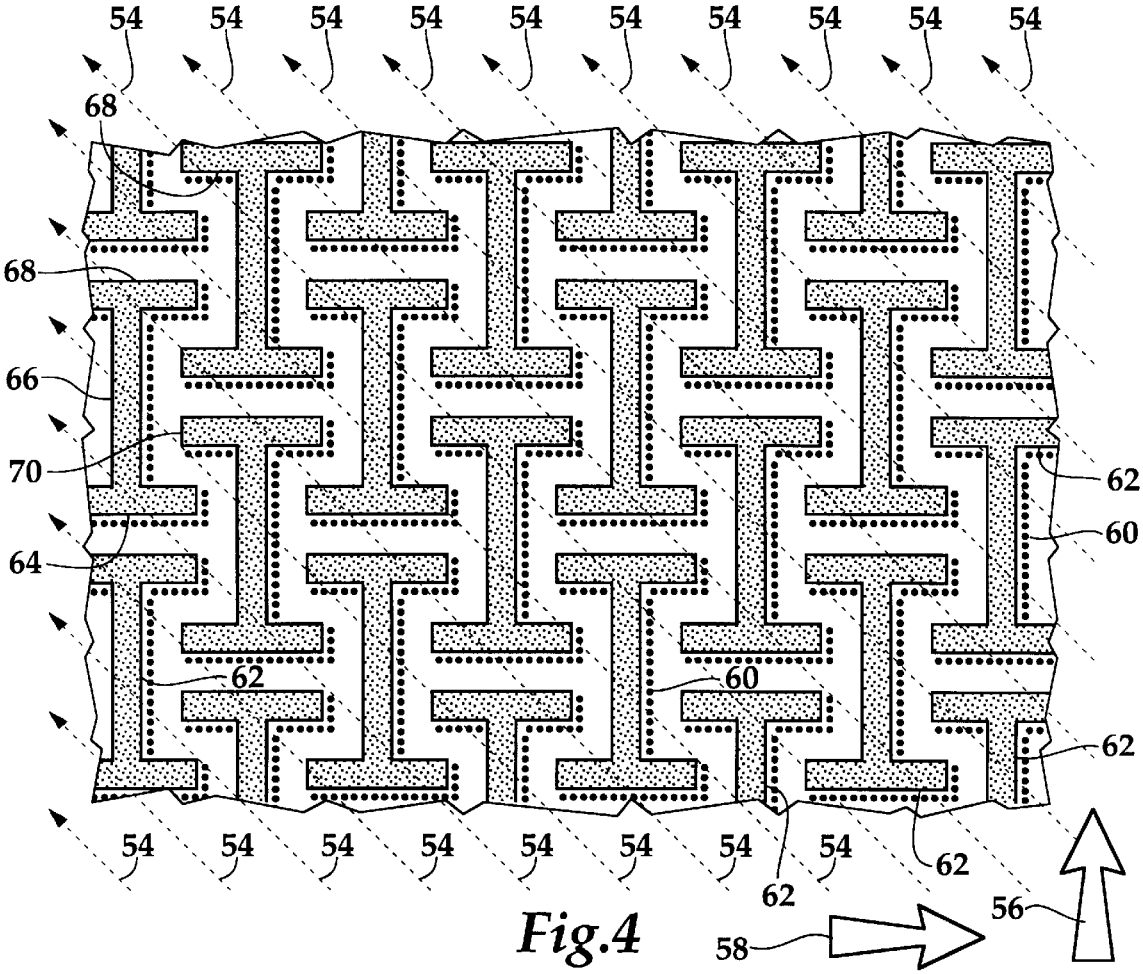
FIG. 4 is a schematic plan of the refiner disk of FIG. 2 showing the edges along which fibers are held as they move through the refiner disks.

Each refiner disk sector 31, as shown in FIG. 2, has a multiplicity of I-shaped refiner bars or elements 50. Each I-shaped refiner element 50 has a top segment 64 parallel to a bottom segment 68, the top and bottom segments being joined by a perpendicular body segment 66. Each segment is, for example, about one fourteenth of an inch wide and projects from the surface of the refiner plate about one quarter of an inch high. Adjacent "I" elements 50 are arranged as shown in FIGS. 2–4 to produce a regular pattern of interlocking elements 50 with channels or grooves 52 formed therebetween. Refiner disks are typically fourteen to forty-five inches in diameter, and may be between twelve and seventy inches in diameter. The refiner disks may have larger refiner bars 39, as shown in FIG. 2, which direct the stock into the refining elements 50.

The refiner disks 28, 30 rotate with respect to one another at rates of between nine hundred to eighteen hundred rpm. As the disks are spun about a common axis, the refiner bars of the opposed disks pass in close proximity to one another and perform the refining action.

In operation, the gap between the refiner disks 28, 30 mounted on the rotors 32, 34 is typically 0.003 to 0.008 inches.

The design of refiner disks requires recognition of criteria for improving the performance of the disks. The first of these design criteria is the km/rev. This criteria is a measure of the total length of cutting edges on bars on a given disk. The desirability of increasing the total length of the bars on the disk is understood in terms of the desirability of causing the abrasion of the pulp fibers with as low an intensity as possible. The power consumed by the disc refiner 20 is dissipated over the area of the refiner disks 28, 30.

By increasing the effective length of the bars or the number of the bars, the amount of power dissipated per unit length of edge bar is decreased. This goal is accomplished by using discrete elements 50 which are constructed of segments which intersect at approximately ninety degrees. The elements 50 are short, with an aspect ratio calculated as the ratio of the longer dimension of the element to the shorter dimension of the element, of less then about two and one-half. Because power dissipation is proportional to the abrasion action, the net result of increased bar edge length created by using low aspect ratio elements with greater edge length, is that the abrasion takes place over a longer period of time and is thus of lower intensity. Lower intensity results in fewer cut or damaged fibers caused by excessive abrasive action.

As shown in FIG. 4 the pulp flows along lines 54 which are angled with respect to the radial direction indicated by arrow 56, and slightly counter to the direction of rotation shown by arrow 58. As the pulp 60 flows along the direction indicated by arrows 56 it is retained along the sides 62 of the I's which defined the edge length. The increased linear length of the sides compared with conventional straight bars will increase the refining capability of the refiner 20. Refining within the refiner 20 is generally believed to take place principally if not exclusively as stock is forced to flow over the edges of the elements.

The I's of the elements 50 are thus composed of three short bar segments an upper segment 64 a body segment 66 and a lower segment 68 which is identical in shape to the upper segment 64. The upper and lower segments 64, 68 are joined at right angles to the body segment 66. Adjacent bar elements 50 are positioned so that individual segments 64, 66, 68 are arranged in spaced parallel relationship with adjacent segments of adjacent elements thus forming grooves 52 along which fiber stock and steam can flow.

The size of the individual "I" elements 50 can be varied considerably. The individual segments of the elements 50 have a pyramidal cross-section as shown in FIG. 3. The projection of the elements from the surface of the refiner disk can be from about one millimeter to about ten millimeters. The top and bottom bars have a corresponding size range of about 1.75 millimeters to about 10.5 millimeters with individual segments having a width of one to six millimeters. The body segment 66 has a typical height of the same or slightly greater then the length of the top and bottom segments 64, 68. The resulting aspect ratio of the elements 50 is approximately 1.8 to 1.

The shape of the elements 50 provides great strength because the top and bottom segments 64, 68 reinforce and support the body segment 66. Thus the elements 50 are resistant to breaking. The pattern of elements 50 provides grooves 52 which allow steam to readily pass through the elements while at the same time not providing a straight-through path which can allow stock to escape through the refiner disk 28, 30 before the stock has been subjected to the refining action of the bars.

The refiner disk 28, 30 can be constructed of multiple segments, for example twenty-four, or sixteen as shown in FIG. 2. The disk may also be formed as a unitary whole.

The arrangement of the elements 50 is shown in FIG. 2. The individual elements 50 are preferably arranged in rectangular arrays, such as those shown in FIGS. 3–8. Trapezoidal portions 72 of the rectangular arrays are cut to fit the pie-shaped refiner disk sectors. The narrowest side 73 of the trapezoidal portion 72 is oriented towards the axis 36 of the rotor when the disk is installed in the refiner 20. The number of trapezoidal portions 72 can be varied depending on the size of the sector 31. If the sector is large, more trapezoidal portions 72 may be required. In FIG. 2 the sector 31 has two trapezoidal array portions 72. The arrays of elements could also be arranged so that the elements 50 are angled zero to ten degrees from the radial direction as shown generally in FIG. 2.

Figure 5:
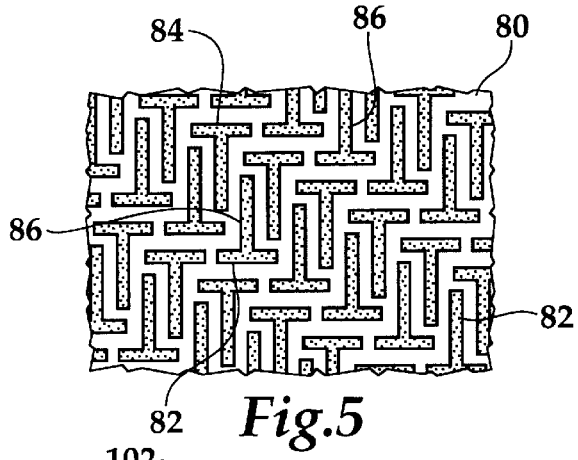
FIG. 5 is a fragmentary top plan view of an alternative pattern of refiner bars which can be placed on the refiner disk of this invention.

An alternative embodiment refiner disk 80, shown in FIG. 5, has T-shaped elements 82. The T-shaped elements 82 have top segments 84 and body segments 86 which join at right angles. The top segments 84 and the body segments 86 are arranged in spaced parallel relation with the segments of adjacent elements 82 to form the pattern shown in FIG. 5. The pattern shown in FIG. 5 can be arranged similarly to the pattern shown in FIG. 2. The elements 82 have an aspect ratio of approximately two.

Figure 6:
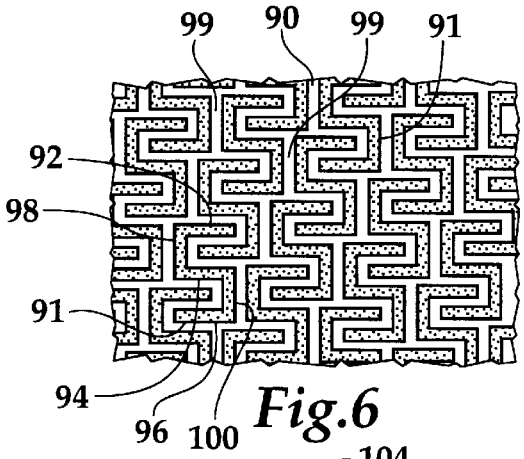
FIG. 6 is a fragmentary top plan view of another alternate pattern of refiner bars which can be placed on the refiner disk of this invention.

A further embodiment refiner disk 90, shown in FIG. 6, has S-shaped elements 91. Each S-shaped element 91 is composed of upper segments 92 middle segments 94 and bottom segments 96 joined by upper side segments 98 and lower side segments 100. The five segments join at right angles and form grooves 99 with adjacent elements 91. The aspect ratio of the elements 91 is approximately 1.4.

Figure 7:
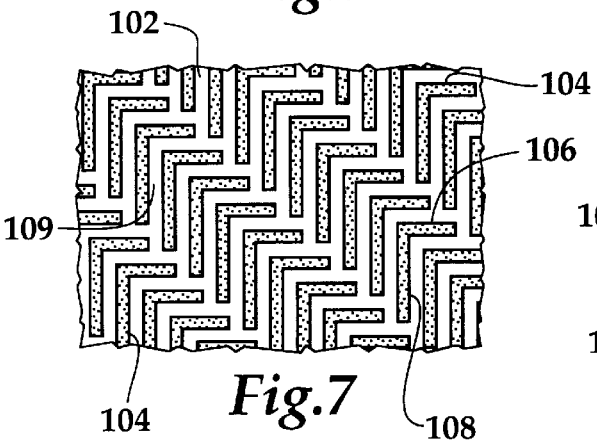
FIG. 7 is a fragmentary top plan view of still further alternative pattern of refiner bars which can be placed on the refiner disk of this invention.

A still further embodiment refiner disk 102, shown in FIG. 7, has L-shaped elements 104. Each L-shaped element is composed of a short segment 106 and a long segment 108. The short segments 106 join the long segments 108 at right angles. The segments form grooves 109 with adjacent elements 104. The aspect ratio of the L-shaped segments is approximately two.

Figure 8:
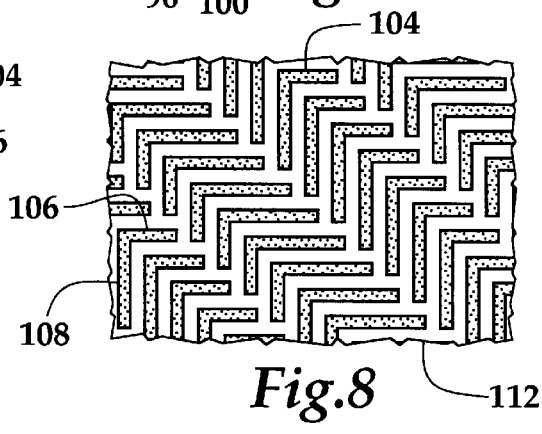
FIG. 8 is a fragmentary top plan view of an alternative arrangement of the refiner bars of FIG. 7 on the refiner disk of this invention.

An alternative embodiment refiner disk 112, shown in FIG. 8, has an alternative arrangement of the L shaped elements 104. The long segments 108 are positioned adjacent to the long segments of adjacent elements. The short segments 106 are positioned adjacent to short segments of adjacent elements.

Figure 9:
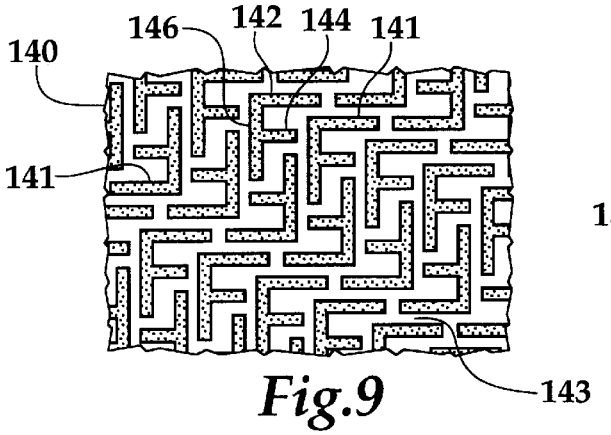
FIG. 9 is a fragmentary top plan view of an further alternative pattern of refiner bars which can be placed on the refiner disk of this invention.

A yet further embodiment refiner disk 140, shown in FIG. 9, has F-shaped elements 141. Each F-shaped element 141 is composed of upper segments 142 middle segments 144 and long segments 146 which join the upper segments 142 with the middle segments 144. The segments form grooves 143 with adjacent elements 141. The aspect ratio of the elements 141 is approximately two.

Figure 10:
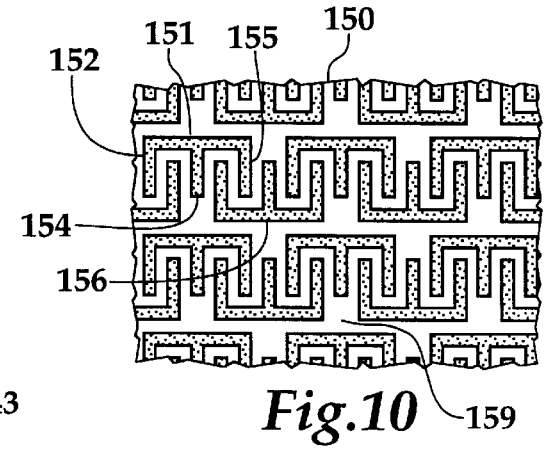
FIG. 10 is a fragmentary top plan view of a yet further alternative pattern of refiner bars which can be placed on the refiner disk of this invention.

A still further embodiment refiner disk 150, shown in FIG. 10, has E-shaped elements 151. Each E-shaped element 151 is composed of first segments 152, second segments 154, third segments 155 and long segments 156 which join the first, second, and third segments 152, 154, and 155. The segments form grooves 159 with adjacent elements 151. The aspect ratio of the elements 151 is approximately two.

Figure 11:
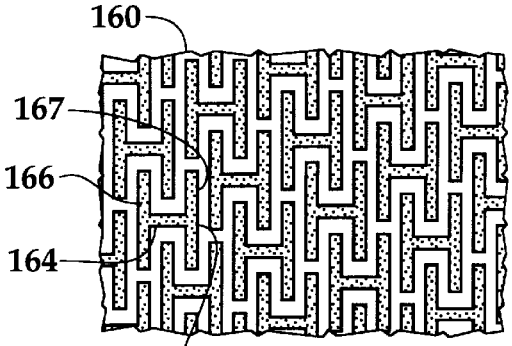
FIG. 11 is a fragmentary plan view of yet another alternative pattern of refiner bars which can be placed on the refiner disk this invention.

A further embodiment refiner disk 160, shown in FIG. 11, has H-shaped elements 161. Each H-shaped element 161 is composed of a middle segments 164, joining a first and second long segments 166, 167. The segments form grooves 169 with adjacent elements 161. The aspect ratio of the elements 161 is approximately two.

As shown in FIGS. 2–8, the refiner disks of this invention provide increased openness, and eliminate the use of dams between refiner elements or bars while retaining necessary bar strength, by creating a tiled array of elements 50. The elements 50 protrude axially from the refiner disks 28, 30.

It is important that the bar patterns of the refiner disk result in most fibers being brought to the outwardly facing bar surfaces where the desirable fraying of fibers can take place. Fibers which reside within a groove between bars and pass the entire length of the disk without passing over the tops of the bars do not benefit from the refining processing. Fibers can be forced to the surface without flow dams between neighboring bars by the shape of the elements 50 which produce flow retaining bar portions or edges. The shape of the bars provides the retaining function without limiting the free flow of steam through the refiner disks.

Computer-aided design techniques make the manufacture of disk patterns with a complicated geometry an economical undertaking. The manufacture of the refiner bars 50 is aided by the use of casting techniques which allow features of smaller dimension to be formed, such as those techniques which employ fine-grained sands with an organic binder rather than conventional green sand castings.

It should be noted that the illustrated arrays of "I" elements may be arranged in various ways on the refiner disks. Furthermore, the refiner bars are preferably cast of white cast iron, stainless steel or other alloys combining the features of strength, wear resistance and cost-effectiveness.

It should also be understood that while the "I" and other shaped refiner bars or elements of this invention are illustrated as being of a uniform size and radial direction, the size of the I's or other refining element may be varied to adjust the open area of the disk.

The refiner elements have a maximum dimension which is vertical as the letters which correspond to the elements are normally written. This vertical dimension will typically be aligned within zero to five degrees from a radial direction.

It should be under stood that the individual elements are not connected by dams, and on the other hand down grooves formed between the elements have straight path lengths which are at most only a little longer than the maximum dimension of the elements.

It should also be understand that although the illustrated refiner 20 is of the Bauer style counter-rotating machine, other types of high consistency refiners, including but not limited to Sprout Twins, and Sunds RGP types may be employed with the refiner disks of this invention.

It should be understood that the invention is not limited to the particular construction and arrangement of parts herein illustrated and described, but embraces such modified forms thereof as come within the scope of the following claims.

We claim:

1. A refiner disk in a refiner for refining a stock slurry comprising:

a disk member which extends radially about an axis, the disk having a refining surface;

a plurality of pairs of interlocking, aligned refiner elements covering a majority of the refining surface, substantially all the refiner elements having a shape selected from the group of shapes consisting of letters I, S, E, and H, the refiner elements being projections which extend axially from the disk member and define a plurality of grooves therebetween; and wherein the plurality of grooves are connected, and wherein the plurality of pairs of the refiner elements are not connected.

2. The refiner of claim 1 wherein the elements have a vertical dimension defined, as the letters are normally written and the vertical dimension is aligned within zero to ten degrees of a line extending radially from the axis.

3. The refiner of claim 1 therein the refiner elements are arranged in a rectangular array in trapezoidal sections which are arranged on the refiner disk with the smallest side facing the refiner axis.

4. The refiner of claim 1 wherein the grooves define a plurality of paths for a) the stock slurry to follow, and b) the steam generated during operation of the refiner to follow with each of the paths 1) extending generally radially from adjacent an inner radial periphery of the disk member to adjacent an outer radial periphery of the disk member, and 2) having a plurality of pairs of straight portions and a plurality of pairs of curved portions such that each of the paths i) is not straight along its entire length and ii) is not curved along its entire length.

5. The refiner of claim 1 wherein 1) the refiner elements are arranged in a plurality of pairs of aligned rows with each of the rows having a plurality of pairs of the refiner elements;

2) each one of the plurality of pairs of the refiner elements in each of the plurality of pairs of the rows are made up of a plurality of pairs of refiner element segments that are arranged to form a pair of connected U-shaped halves with each one of the halves having an opening and a refiner element end segment; and 3) the plurality of pairs of the refiner elements in each one of the plurality of pairs of the rows are arranged such that each one of the plurality of pairs of the refiner elements has i) a portion of one refiner element end segment received in one of the openings in one of the halves of one of the refiner elements in an adjacent one of the rows and ii) a portion of another refiner element end segment received in one of the openings in one of the halves of one of the refiner elements in an adjacent other one of the rows.

6. The refiner of claim 5 wherein, for each of the plurality of pairs of refiner elements in each of the plurality of pairs of rows, the refiner element segments are arranged such that one of the U-shaped halves is facing in one direction and the other of the U-shaped halves is facing in another direction.

7. The refiner of claim 6 wherein the U-shaped halves are disposed generally side-by-side and face in opposite directions to form a capital letter "S".

8. The refiner of claim 6 wherein the U-shaped halves are disposed one in front of the other and face in opposite directions to form a capital letter "H".

9. The refiner of claim 5 wherein, for each of the plurality of pairs of refiner elements in each of the plurality of pairs of rows, the refiner element segments are arranged such that one of the U-shaped halves is oriented in one direction and the other of the U-shaped halves is oriented generally in the same direction.

10. The refiner of claim 9 wherein the U-shaped halves are disposed generally side-by-side to form a capital letter "E".

11. The refiner of claim 1 wherein 1) the refiner elements are arranged in a plurality of pairs of rows with each of the rows having a plurality of pairs of the refiner elements; 2) each of the plurality of pairs of the refiner elements in each of the plurality pairs of rows is made up of at least a pair of refiner element segments with one of the refiner element segments joined to the other of the refiner element segments such that an angle is formed therebetween; and 3) the one refiner element segment of each of the plurality of pairs of the refiner elements in one of the rows overlaps the one refiner element segment of a closest one of the refiner elements in an adjacent one of the rows along a direction generally transverse to the one refiner element segment, and the other refiner element segment of each of the refiner elements in the one of the rows overlaps the other refiner element segment of the closest one of the refiner elements in the adjacent one of the rows along a direction generally parallel to the one refiner element segment.

12. The refiner of claim 11 wherein the plurality of pairs of refiner elements in one of the rows is staggered relative to the plurality of pairs of refiner elements in an adjacent one of the rows such that the one refiner element segment of each of the plurality of pairs of the refiner elements in the one of the rows partially overlaps the one refiner element segment of the closest one of the refiner elements in the adjacent one of the rows and the other refiner element segment of each of the refiner elements in the one of the rows partially overlaps the other refiner element segment of the closest one of the refiner elements in the adjacent one of the rows.

13. The refiner of claim 1 wherein 1) the refiner elements are arranged in an array of refiner elements that includes i) a plurality of pairs rows of aligned and radially spaced apart refiner elements that extend radially outwardly with each of the rows having a plurality of pairs of the refiner elements and ii) a plurality of pairs of columns of aligned and spaced apart refiner elements that are disposed at an angle relative to the rows with each of the columns having a plurality of pairs of the refiner elements, 2) the refiner elements in one of the rows is radially staggered with respect to the refiner elements in an adjacent one of the rows such that a portion of each one of the refiner elements in the one of the rows overlaps an adjacent one of the refiner elements in the adjacent one of the rows along a direction generally transverse to the direction of the one of the rows, and 3) each of the refiner elements in the one of the rows overlaps a portion of an adjacent one of the refiner elements in the adjacent one of the rows along a direction generally parallel to the direction of the one of the rows.

14. The refiner of claim 13 wherein each of the refiner elements in the one of the rows 1) overlaps a portion of the adjacent one of the refiner elements along a direction that is transverse to the direction of the one of the rows and 2) overlaps a portion of the adjacent one of the refiner elements along a direction that is parallel to the direction of the one of the rows.

15. The refiner of claim 1 wherein 1) the refiner elements are arranged in a plurality of pairs of rows with each of the rows having a plurality of pairs of the refiner elements; 2) each of the plurality of pairs of the refiner elements has at least two joined refiner element segments with one of the refiner element segments being longer than another of the refiner element segments; and 3) the longer refiner element segment of each of the plurality of pairs of the refiner elements in one of the rows overlaps the longer refiner element segment of an adjacent one of the refiner elements in an adjacent one of the rows along a direction generally transverse to the longer refiner element segment and the shorter refiner element segment of each of the refiner elements in the one of the rows overlaps the shorter refiner element segment of an adjacent one of the refiner element in the adjacent one of the rows along a direction generally parallel to the longer refiner element segment.

16. The refiner of claim 15 wherein the plurality of pairs of refiner elements in one of the rows is staggered relative to the plurality of pairs of refiner elements in an adjacent one of the rows such that the longer refiner element segment of each of the plurality of pairs of the refiner elements in one of the rows partially overlaps the longer refiner element segment of an adjacent one of the refiner elements in an adjacent one of the rows and the shorter refiner element segment of each of the refiner elements in the one of the rows partially overlaps the shorter refiner element segment of an adjacent one of the refiner elements in the adjacent one of the rows.

17. The refiner of claim 16 wherein the disk member has a radially inner edge and a radially outer edge and the plurality of pairs of grooves defines a plurality of pairs of meandering paths for steam and fibers in the stock to follow that extend from adjacent the radially inner edge to adjacent the radially outer edge.

18. The refiner of claim 15 wherein the aspect ratio of the length of the longer refiner element segment divided by the length of the shorter refiner element segment is no greater than about 2.5:1.

19. The refiner of claim 18 wherein the shorter refiner element segment is straight and the longer refiner element segment is straight.

20. The refiner of claim 19 wherein the shorter refiner element segment and the longer refiner element segment are joined at a substantially right angle.

21. The refiner of claim 18 wherein each refiner element axially projects between about 1 millimeter and about 10 millimeters from the disk member with its shorter refiner element segment having 1) a length of between about 1.75 millimeters and about 10.5 millimeters and 2) a width of 1 to 6 millimeters.

22. The refiner of claim 15 wherein each of the refiner elements has 1) a base where the refiner element projects from the disk member, 2) an axial refining end surface, and 3) a frustoconical cross section such the base is wider than the axial refining end surface.

23. The refiner of claim 15 wherein a) there are a pair of the disk members oriented such that the refiner elements of one of the disk members opposes the refiner elements of the other of the disk members, b) the disk members are spaced apart such that there is a gap of between 0.003 inches and 0.008 inches, and c) during operation 1) the refiner refines a stock slurry having between 18% and 60% wood chips, fiber, or wood chips and fiber, and 2) one of the disk members rotates relative to the other of the disk members at a relative rotational speed of between 900 and 1800 revolutions per minute.

24. The refiner of claim 1 wherein the disk member has a radially inner edge and a radially outer edge and the plurality of pairs of grooves defines a plurality of pairs of paths that transport generated steam and the stock slurry, the paths extending from adjacent the radially inner edge to adjacent the radially outer edge that are each 1) not straight along the entire path length, and 2) not curvilinear along the entire path length.

25. A disk refiner and pair of opposed refiner disks that mount on the disk refiner comprising:

at least one refiner disk segment making up one of the refiner disks mounted on the refiner to form a substantially annular refining region having an inner edge near an axis about which the disk rotates and an outer edge near the periphery of the refiner disk;

each refiner disk segment extending substantially radially from the axis and having a pattern of upraised refiner elements and grooves between the refiner elements, wherein material being refined and steam produced during refining flows in the grooves in the general direction from the inner edge towards the outer edge of the refining region, the pattern including;

a plurality of pairs of the refiner elements covering a substantial portion of the entire surface of the plate and arranged in a plurality of pairs of generally parallel rows with each of the rows having a plurality of pairs of the refiner elements;

wherein each refiner element has at least two joined straight segments with one of the segments being longest relative to another of the segments such that the ratio of the length of the longest segment relative to the length of a segment that is shorter is no greater than about 2.5:1;

wherein the longest segment of each refiner element in one of the generally parallel rows overlaps, but does not contact, the longest segment of an adjacent one of the refiner elements in an adjacent one of the generally parallel rows along a direction generally transverse to the longest segment and the shorter segment of each refiner element in the one of the generally parallel rows overlaps, but does not contact, the shorter segment of an adjacent one of the refiner elements in the adjacent one of the generally parallel rows along a direction generally parallel to the longest segment.

26. The disk refiner of claim 25 wherein the refiner elements have a shape selected from the group consisting of the shape of letters I, T, L, F, E and H.

27. The refiner of claim 26 wherein the elements have a vertical dimension defined, as the letters are normally written, and the vertical dimension is aligned within zero to ten degrees of a plane extending through the axis of the refiner rotor.

28. The refiner of claim 25 therein the refiner elements are arranged in a rectangular array in trapezoidal sections having a smallest side, the trapezoidal sections being arranged on the refiner disk with the smallest side facing towards a refiner disk axis.

29. The refiner of claim 25 wherein the refiner disk has a radially inner edge and a radially outer edge and the grooves between the refiner elements define a plurality of pairs of spaced apart and meandering paths that each guide the steam and the material being refined from the radially inner edge to the radially outer edge.

30. The refiner of claim 29 wherein the longest segment and the shorter segment are joined at a substantially right angle.

31. The refiner of claim 25 wherein a) the refining disks are oriented such that the refiner elements of one of the refining disks faces the refiner elements of the other of the refining disks, b) the refining disks are spaced apart such that there is a gap of between 0.003 inches and 0.008 inches between them, and c) during operation 1) the refiner refines a stock comprised of between 18% and 60% of one of wood chips, fiber, and wood chips and fiber contained in a liquid, and 2) one of the refiner disks rotates relative to the other of the refiner disks at a relative rotational speed of between 900 and 1800 revolutions per minute.

32. A refiner that refines matter in a slurry comprising:

a pair of opposed refiner disks capable of relative rotation therebetween wherein each of the refiner disks has a refining surface, with the refining surface of one of the refiner disks facing the refining surface of the other of the refiner disks and spaced apart by a gap;

wherein the refining surface of at least one of the refiner disks includes a plurality of pairs of substantially parallel rows of axially upraised and spaced apart refiner elements that define a plurality of flow channels therebetween and have a plurality of pairs of the refiner elements in each of the rows;

wherein each refiner element has a first segment joined at an angle to a second segment;

wherein one of the segments of each of the refiner elements of one of the rows overlaps, but is spaced apart from, one of the segments of one of the refiner elements of another of the substantially parallel rows along a direction generally parallel to the direction of the one of the rows; and wherein the other of the segments of each of the refiner elements of the one of the rows overlaps, but is spaced apart from, the other of the segments of one of the refiner elements of the another of the substantially parallel rows along a direction generally transverse to the direction of the one of the rows.

33. The refiner of claim 32 wherein a) the gap is between 0.003 inches and 0.008 inches, and b) during operation 1) the refiner refines a stock slurry comprised of 18% to 60% wood chips, fiber, or wood chips and fiber, and 2) one of the refiner disks rotates relative to the other of the refiner disks at a relative rotational speed of between 900 and 1800 revolutions per minute.

34. The refiner of claim 32 wherein the segments of each of the refiner elements are arranged generally in a vee-shape.

35. The refiner of claim 34 wherein each of the vee-shaped refiner elements comprises an uppercase letter "L" with a plurality of pairs of the L-shaped refiner elements in each of the rows being nested with another L-shaped refiner element in that same row.

36. The refiner of claim 35 wherein, for each of the L-shaped refiner elements, the first segment is straight, the second segment is straight, and the first segment is joined at a substantially right angle to the second segment, and each of the L-shaped refiner elements has an aspect ratio of the length of its longest segment to the length of its shortest segment of no greater than about 2.5:1.

37. The refiner of claim 36 wherein the aspect ratio is about 2:1.

38. The refiner of claim 32 wherein each of the refiner elements comprises the first segment joined at one end to the second segment and joined at its other end to a third segment to form an uppercase letter "I" wherein the first segment and the third segment are each shorter in length than the second segment resulting in an aspect ratio of no greater than about 2.5:1 wherein the aspect ratio is the length of the first segment divided by the second segment or the third segment.

39. The refiner of claim 38 wherein each of the segments projects axially from the refiner disk between about 1 millimeter and about 10 millimeters and the second segment and the third segment are between about 1.75 millimeters and about 10.5 millimeters long and between 1 millimeter and 6 millimeters wide.

40. The refiner of claim 38 wherein the second segment and the third segment of each of the refiner elements in one of the rows 1) overlap the second segment and the third segment of the closest refiner element of an adjacent one of the rows along a direction generally parallel to the first segment of the refiner element of the one of the rows, and 2) overlap the second segment and the third segment of the closest refiner element of an adjacent other of the rows along a direction generally parallel to the first segment of the refiner element of the one of the rows such that the grooves formed between the segments of the overlapping refiner elements of the one of the rows, the adjacent one of the rows, and the adjacent other of the rows define a plurality of pairs of passages each capable of transporting the slurry from adjacent a radially inner edge of the refiner disk to adjacent a radially outer edge of the refiner disk and each passage of which is not straight in a radially outward direction.

41. The refiner of claim 40 wherein each of the rows of refiner elements extends generally in a radial direction.

42. The refiner of claim 38 wherein the segments of each of the refiner elements are arranged to form an uppercase letter "S".

43. The refiner of claim 42 wherein each of the refiner elements have an aspect ratio of no greater than about 2.5:1.

44. The refiner of claim 43 wherein each of the refiner elements has an aspect ratio of about 1.4:1.

45. The refiner of claim 42 wherein each of the refiner element is comprised of five straight segments joined to form the uppercase letter "S".

46. The refiner of claim 42 wherein 1) each S-shaped refiner element has an upper half with segments arranged in a U-shape having an opening facing in one direction and an end segment and a lower half with segments arranged in a U-shape having an opening facing in another direction and an end segment, 2) the end segment of the lower half of one of each of the refiner elements of one of the rows is received in the opening in the upper half of one of the refiner elements in one of the adjacent rows and the end segment of the upper half of the refiner element of the one of the rows is received in the opening in the lower half of one of the refiner element in the other of the adjacent rows.

47. The refiner of claim 42 wherein each S-shaped refiner element in each of the rows interlocks with another S-shaped refiner element in its same row.

48. The refiner of claim 32 wherein the segments of each refiner element are arranged to form a pair of connected U-shaped halves with each one of the halves having an opening and an end segment wherein a plurality of pairs of refiner segments in each one of the rows are arranged such that each one of the plurality of pairs of refiner elements have 1) one end segment received in one of the openings in one of the halves of one of the refiner elements in an adjacent one of the rows and 2) the other end segment received in one of the halves of one of the refiner elements in an adjacent other one of the rows.

49. The refiner of claim 32 wherein at least one of the refiner disks are comprised of a plurality of refiner disk segments arranged to form a ring with each of the refiner disk segments having its own refining surface.

50. A refiner that refines wood or fiber in a slurry comprising:

a pair of opposed refiner disks capable of relative rotation therebetween wherein each of the refiner disks has a refining surface, with the refining surface of one of the refiner disks facing the refining surface of the other of the refiner disks;

wherein the refining surface of at least one of the refiner disks has a multiplicity of axially upraised and spaced apart refining elements that define grooves therebetween through which the slurry and steam generated during operation of the refiner can travel;

wherein 1) the refiner elements are arranged in a plurality of pairs of rows with each of the rows having a plurality of pairs of the refiner elements, 2) each of the plurality of pairs of the refiner elements in each of the plurality of pairs of the rows are made up of a plurality of pairs of segments that are arranged to form a pair of connected U-shaped portions with each one of the U-shaped portions having an opening and an end segment, and 3) the plurality of pairs of refiner elements in each one of the rows are arranged such that each one of the plurality of pairs of refiner elements has i) one end segment received in one of the openings in one of the U-shaped portions of one of the refiner elements in an adjacent one of the rows and ii) another end segment received in one of the U-shaped portions of one of the refiner elements in an adjacent other one of the rows.

51. The refiner of claim 50 wherein each of the refiner elements have a shape selected from one of the group consisting of the letters S, E, and H.

52. A refiner that refines wood or fiber in a slurry comprising:

a pair of opposed refiner disks capable of relative rotation therebetween wherein each of the refiner disks has a refining surface, with the refining surface of one of the refiner disks facing the refining surface of the other of the refiner disks;

wherein the refining surface of at least one of the refiner disks has a plurality of pairs of upraised and spaced apart refiner elements that define grooves therebetween through which the slurry and steam generated during operation of the refiner can travel;

wherein each of the plurality of pairs of the refiner elements has at least a pair of segments with one of the segments joined to the other of the segments forming an angle therebetween; and the one segment of each of the plurality of pairs of the refiner elements overlaps the one segment of an adjacent one of the refiner elements along a first direction relative to the direction of the one segment, and the other segment of each of the plurality of pairs of the refiner elements overlaps the other segment of the adjacent one of the refiner elements along a second direction relative to the direction of the one segment;

wherein there are a plurality of pairs of interlocked refiner element pairs with each of the refiner elements of each of the interlocked refiner element pairs being spaced apart by a portion of one of the grooves; and wherein the portion of each groove that spaces apart interlocked refiner element pairs is not straight.

53. The refiner of claim 52 wherein each of the refiner elements have a shape selected from one of the group consisting of the letters I, S, T, F, E, and H.

54. The refiner of claim 52 wherein at least one of the segments of each of the refiner elements is straight.

55. The refiner of claim 52 wherein there is no dam between a plurality of the interlocked refiner element pairs.

56. The refiner of claim 55 wherein the first direction is a direction generally transverse to a lengthwise direction of the one segment and the second direction is a direction generally parallel to the lengthwise direction of the one segment.

57. The refiner of claim 52 wherein the refiner elements are arranged in a plurality of generally aligned rows.

58. A refiner that refines wood or fiber in a slurry comprising:

a pair of opposed refiner disks capable of relative rotation therebetween wherein each of the refiner disks has a refining surface, with the refining surface of one of the refiner disks facing the refining surface of the other of the refiner disks;

wherein the refining surface of at least one of the refiner disks has a multiplicity of axially upraised and spaced apart refiner elements that define grooves therebetween through which the slurry and steam generated during operation of the refiner can travel;

wherein 1) the refiner elements are arranged in a plurality of pairs of rows with each of the rows having a plurality of pairs of the refiner elements; 2) each of the plurality of pairs of the refiner elements has at least two joined segments with one of the segments being longer than another of the segments; and 3)i) the longest segment of each of the plurality of pairs of the refiner elements in one of the rows overlaps the longest segment of an adjacent one of the refiner elements in an adjacent one of the rows along a direction generally transverse to the longest segment and ii) the shorter segment of each of the refiner elements in the one of the rows overlaps the shorter segment of an adjacent one of the refiner elements in the adjacent one of the rows along a direction generally parallel to the longest segment; and wherein the grooves define a plurality of pairs of paths that extend from adjacent a radially inner periphery of the refiner disk to adjacent a radially outer periphery of the refiner disk such that steam generated during operation of the refiner travels radially outwardly relative to the refiner disk to escape from between the refiner disks and wherein each of the paths is 1) obstructed in a radial direction by one or more the refiner elements and 2) made up of i) a plurality of pairs of straight portions and ii) a plurality of pairs of curved portions.

59. The refiner of claim 58 wherein the plurality of pairs of refiner elements in one of the rows is staggered relative to the plurality of pairs of refiner elements in an adjacent one of the rows such that the longest segment of each of the plurality of pairs of the refiner elements in one of the rows partially overlaps the longest segment of an adjacent one of the refiner elements in an adjacent one of the rows and the shorter segment of each of the refiner elements in the one of the rows partially overlaps the shorter segment of an adjacent one of the refiner element in the adjacent one of the rows.

60. A refiner that refines wood or fiber in a slurry comprising:

a pair of opposed refiner disks capable of relative rotation therebetween wherein each of the refiner disks has a refining surface, with the refining surface of one of the refiner disks facing the refining surface of the other of the refiner disks;

wherein the refining surface of at least one of the refiner disks has a a plurality of pairs of upraised and spaced apart refiner elements that define grooves therebetween through which the slurry can travel during operation of the refiner;

wherein 1) the refiner elements are arranged in an array of refiner elements that includes i) a plurality of pairs rows of generally aligned and radially spaced apart refiner elements that extend generally radially outwardly with each of the rows having a plurality of pairs of the refiner elements and ii) a plurality of pairs of columns of generally aligned and spaced apart refiner elements that are disposed at an angle relative to the rows with each of the columns having a plurality of pairs of the refiner elements, 2) the refiner elements in one of the rows is radially staggered with respect to the refiner elements in an adjacent one of the rows such that a portion of each one of the refiner elements in the one of the rows overlaps an adjacent one of the refiner elements in the adjacent one of the rows along a direction generally transverse to the direction of the one of the rows, and 3) each of the refiner elements in the one of the rows overlaps a portion of an adjacent one of the refiner elements in the adjacent one of the rows along a direction generally parallel to the direction of the one of the rows; and wherein a plurality of the refiner elements in one of the rows interlock with a plurality of refiner elements in another one of the rows without contacting each other.

61. The refiner of claim 60 wherein each of the refiner elements in the one of the rows 1) overlaps a portion of the adjacent one of the refiner elements along a direction that is transverse to the direction of the one of the rows and 2) overlaps a portion of the adjacent one of the refiner elements along a direction that is parallel to the direction of the one of the rows.

62. The refiner of claim 60 wherein the refiner disk is comprised of a plurality of refiner disk segments each having a plurality of pairs of arrays of the refiner elements with one of the arrays offset at an acute angle relative to the other of the arrays.

63. A refiner that refines stock comprised of between 18% and 60% of one of wood chips, fiber, and wood chips and fiber in a liquid comprising:

a pair of opposed refiner disks having at least one of the refiner disks rotated relative to the other of the refiner disks at a relative rotational speed of between 900 and 1800 revolutions per minute wherein each of the refiner disks has a refining surface, with the refining surface of one of the refiner disks facing the refining surface of the other of the refiner disks and spaced apart by a gap of between 0.003 inches and 0.008 inches;

wherein the refining surface of at least one of the refiner disks has a multiplicity of axially upraised refiner elements that define grooves therebetween through which the stock and steam generated during operation of the refiner can travel with the refiner elements spaced apart such that no dams of a lesser axial height extend therebetween;

wherein 1) the refiner elements are arranged in an array of refiner elements that includes i) a plurality of pairs rows of aligned and radially spaced apart refiner elements that extend radially outwardly with each of the rows having a plurality of pairs of the refiner elements and ii) a plurality of pairs of columns of aligned and spaced apart refiner elements that are disposed at an angle relative to the rows with each of the columns having a plurality of pairs of the refiner elements, 2) the refiner elements in one of the rows are radially staggered with respect to the refiner elements in an adjacent one of the rows such that a portion of each one of the refiner elements in the one of the rows overlaps a portion of an adjacent one of the refiner elements in the adjacent one of the rows along a direction generally transverse to the direction of the one of the rows, and 3) a portion of each of the refiner elements in the one of the rows overlaps a portion of an adjacent one of the refiner elements in the adjacent one of the rows along a direction generally parallel to the direction of the one of the rows; and wherein the grooves make up a plurality of pairs of meandering paths that extend from adjacent a radially inner periphery of the refiner disk to adjacent a radially outer periphery of the refiner disk such that steam generated during operation of the refiner travels generally radially outwardly relative to the refiner disk to escape from between the opposed refiner disks and wherein each of the paths is obstructed in a radial direction by one or more the refiner elements such that each of the paths is made up of i) a plurality of pairs of straight portions and ii) a plurality of pairs of curved portions.

* * * * *